US006507274B1

(12) United States Patent
Morishima

(10) Patent No.: US 6,507,274 B1
(45) Date of Patent: Jan. 14, 2003

(54) DATA DISPLAY RADIO PAGER

(75) Inventor: Masaaki Morishima, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/459,835

(22) Filed: Dec. 13, 1999

(30) Foreign Application Priority Data

Dec. 14, 1998 (JP) ..... 10-354711

(51) Int. Cl.[7] ..... G08B 5/22

(52) U.S. Cl. ..... 340/7.55; 340/7.52; 340/311.2

(58) Field of Search ..... 340/7.1, 7.52, 340/7.55, 7.56, 7.43, 7.48, 7.21, 825.49, 825.52, 311.2; 455/426, 458, 460, 344

(56) References Cited

U.S. PATENT DOCUMENTS 5,173,688 A * 12/1992 DeLuca et al. ..... 340/7.55
5,933,088 A * 8/1999 Lipp ..... 340/7.55
5,936,548 A * 8/1999 Takatsuka ..... 340/7.55
5,966,113 A * 10/1999 Hidaka et al. ..... 340/7.55

FOREIGN PATENT DOCUMENTS

| | | |
|---|---|---|
| JP | 7-298327 | 11/1995 |
| JP | 9-46743 | 2/1997 |
| JP | 2701835 | 10/1997 |
| JP | 2702436 | 10/1997 |

* cited by examiner

*Primary Examiner*—Van Trieu
(74) *Attorney, Agent, or Firm*—Scully, Scott, Murphy & Presser

(57) ABSTRACT

A data display radio pager of the present invention receives a paging signal including an address number and a message following the address number. If the address number is identical with an address number assigned to the pager, a CPU (Central Processing Unit) writes the message in a RAM (Random Access Memory) while displaying it on an LCD (Liquid Crystal Display). When the user of the pager operates a read switch, the CPU accesses the RAM to display the message stored therein on the LCD. If a receipt interrupt occurs when the CPU is reading the message out of the RAM, the CPU displays both the message stored and an incoming message on the LCD.

7 Claims, 11 Drawing Sheets

*Fig. 5*

| MEMORY NO. AREA | MESSAGE AREA | |
|---|---|---|
| | INCOMING MESSAGE | INCOMING MESSAGE |
| N | MESSAGE N | LATEST MESSAGE |
| N−1 | MESSAGE N−1 | ↕ |
| N−2 | MESSAGE N−2 | |
| | | |
| 2 | MESSAGE 2 | |
| 1 | MESSAGE 1 | OLDEST MESSAGE |

*Fig. 6*

| MEMORY NO. AREA | MESSAGE AREA | |
|---|---|---|
| | PLEASE CALL **-****-**** | ←INCOMING MESSAGE |
| 2 | PLEASE COME TO TOKYO STATION AT 6:00 PM ON NOVEMBER 30 | ← LATEST MESSAGE |
| 1 | HINTS TO CLIMBERS IN WINTER : GUARD AGAINST THE COLD WEATHER ON SOUTH ALPS | ← OLDEST MESSAGE |

| |
|---|
| Fig. 7A |
| Fig. 7B |
| Fig. 7C |

*Fig. 10*

| MEMORY NO. AREA | MESSAGE AREA | |
|---|---|---|
| | MESSAGE | INCOMING MESSAGE |
| N | MESSAGE N | LATEST MESSAGE |
| N−1 | MESSAGE N−1 | ↕ |
| N−2 | MESSAGE N−2 | |
| ⋮ | ⋮ | |
| 2 | MESSAGE 2 | |
| 1 | MESSAGE 1 | OLDEST MESSAGE |

| INFORMATION MESSAGE AREA | |
|---|---|
| INFO_MESSAGE | LATEST INFORMATION MESSAGE |

*Fig. 11*

| MEMORY NO. AREA | MESSAGE AREA | |
|---|---|---|
| | PLEASE CALL **-****-**** | INCOMING MESSAGE |
| 2 | PLEASE COME TO TOKYO STATION AT 6:00 PM ON NOVEMBER 30 | LATEST MESSAGE |
| 1 | HINTS TO CLIMBERS IN WINTER : GUARD AGAINST THE COLD WEATHER IN SOUTH ALPS | OLDEST MESSAGE |

| INFORMATION MESSAGE AREA | |
|---|---|
| DECEMBER 1 WEATHER FORECAST: SAPPORO---CLEAR, NIIGATA---RAIN, TOKYO---CLEAR, OSAKA---CLOUDY, FUKUOKA---CLEAR | LATEST INFORMATION MESSAGE |

| |
|---|
| Fig. 12A |
| Fig. 12B |
| Fig. 12C |

DATA DISPLAY RADIO PAGER

BACKGROUND OF THE INVENTION

The present invention relates to a radio pager and more particularly to a data display radio pager.

Generally, a data display radio pager receives a paging signal, decodes it to produce a corresponding digital signal, and determines whether or not the digital signal includes an address number assigned to the pager. If the answer of this decision is positive, the pager outputs an alert tone, writes a message, if it follows the address number, in a storage, and displays the message on a display as a received message.

The above radio pager includes a read switch and a reset switch. When the user of the pager operates the read switch, the message stored in the storage appears on the display. When the user operates the reset switch when the pager is displaying a received message, a receipt waiting mode is set up.

A problem with the above conventional pager is that when an interrupt due to a receipt (receipt interrupt hereinafter) occurs when the pager is reading out a message out of the storage, the message stored is automatically replaced with an incoming message just received. This forces the user to again operate the read switch when the user desires to see the message having been read out. On the other hand, assume that the message being read out of the storage is held on the display despite a receipt interrupt. Then, the user must repeat the switching operation a plurality of times when the user desires to see an incoming message immediately. In any case, when a receipt interrupt occurs, the conventional pager requires the user to perform a complicated switching operation.

Technologies relating to the present invention are disclosed in, e.g., Japanese Patent Laid-Open Publication Nos. 7-298327 and 9-46743 and Japanese Patent Nos. 2,701,835 and 2,702,463.

SUMMARY OF THE INVENTION

It is therefore an object of the present invention to provide a data display radio pager capable of allowing the user thereof to see a message extremely easily.

A data display radio pager of the present invention includes a a storage for storing a message following an address number included in a paging signal if the address number is identical with an address number assigned to the pager. A display displays the message as a received message. A read switch reads the message out of the storage when operated by the user of the pager. When the read switch is operated, the controller accesses the storage for causing the message to be displayed on the display. In the event of a receipt interrupt occurring when the controller is reading the message out of the storage, the controller causes the message stored and an incoming message to be displayed on the display. Alternatively, in the event of a receipt interrupt occurring when the controller is reading the message out of the storage, and if the incoming message is a preselected information message, the controller may cause the message stored and incoming message to be displayed on the display.

BRIEF DESCRIPTION OF THE DRAWINGS

The above and other objects, features and advantages of the present invention will become more apparent from the following detailed description taken with the accompanying drawings in which:

FIG. 5 shows a specific memory map included in the illustrative embodiment;

FIG. 6 shows the memory map of FIG. 5 more specifically;

FIG. 10 shows another specific memory map;

FIG. 11 shows the memory map of FIG. 10 more specifically; and

DESCRIPTION OF THE PREFERRED EMBODIMENT

Figure 1:
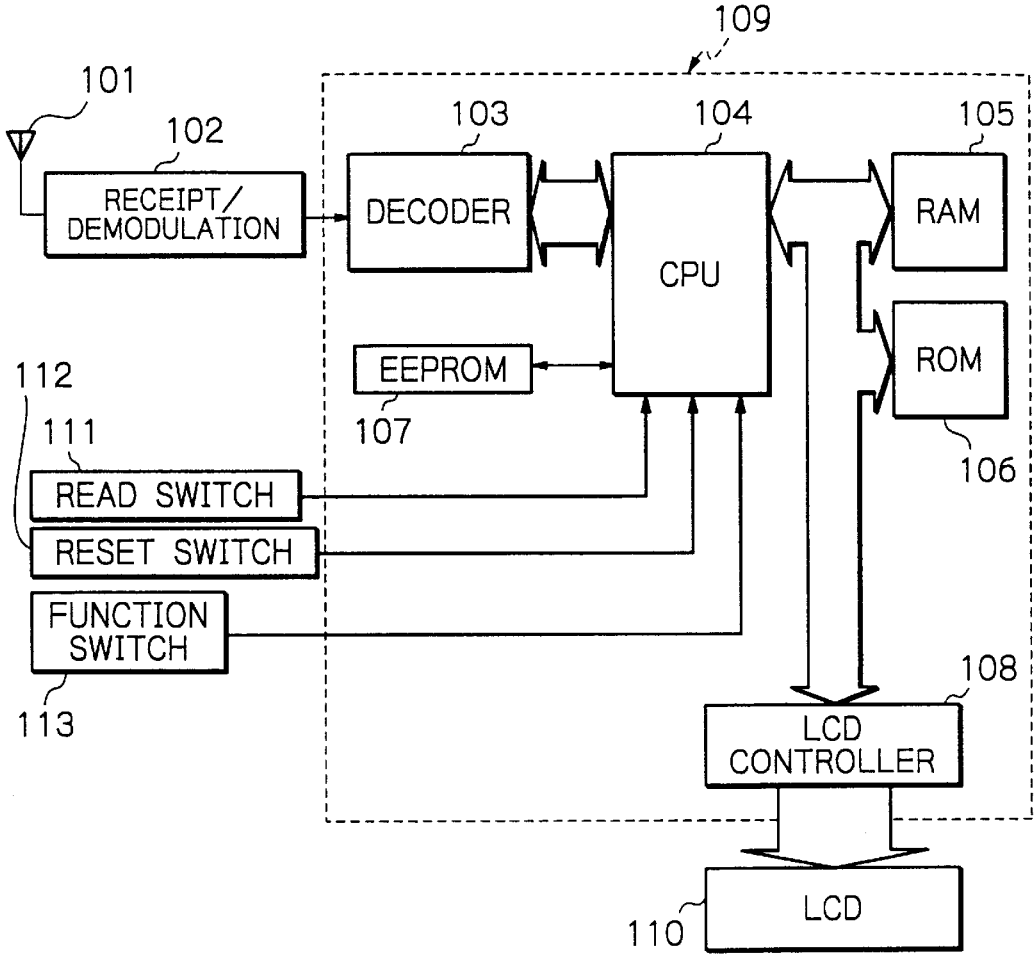
FIG. 1 is a block diagram schematically showing a data display radio pager embodying the present invention.
Figure 2:
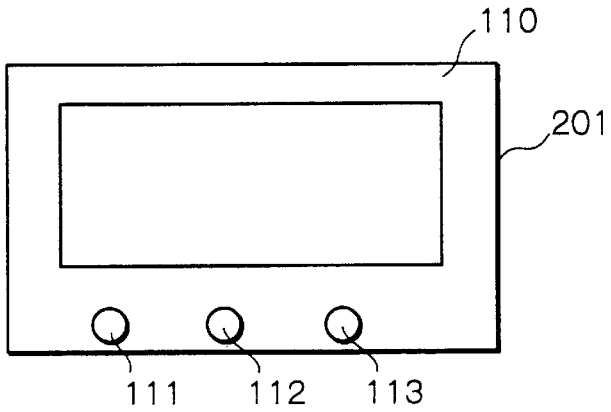
FIG. 2 is an isometric view of the illustrative embodiment.

Referring to FIGS. 1 and 2 of the drawings, a radio pager embodying the present invention is shown and includes an antenna 101. A paging signal coming in through the antenna 101 is input to a receipt/demodulation 102. The receipt/demodulation 102 demodulates the input signal and delivers the resulting signal to a controller 109.

The controller 109 includes a decoder 103, a CPU (Central Processing Unit) 104, a RAM (Random Access Memory) 105, a ROM (Read Only Memory) 106, an EEPROM (Electrically Erasable Programmable ROM) 107, and an LCD (Liquid Crystal Display) controller 108. The demodulated signal output from the receipt/demodulation 102 is input to the decoder 103. The decoder 103 decodes the demodulated signal and feeds the decoded signal to the CPU 104. The CPU 104 determines whether or not the decoded signal includes an address number identical with an address number assigned to the pager and stored in the EEPROM 107. Specifically, when a power switch, not shown, provided on the pager is turned on or when a battery, not shown, is mounted to the pager, the CPU 104 reads the address number stored in the EEPROM 102 and writes it in the RAM 105.

If the address number included in the decoded signal is identical with the address number assigned to the pager, the CPU 104 writes a message following the address number of the decoded signal in the RAM 105. At the same time, the CPU 104 displays the message on an LCD 110 via the LCD controller 108. It is to be noted that the ROM 106 additionally stores, e.g., a program for operating the CPU 104. The decoder 103, CPU 104, RAM 105, ROM 106, LCD controller 108 and EEPROM 107 may be implemented as a single control LSI (Large Scale Integrated) circuit chip, if desired.

As shown in FIG. 1, a read switch 111, a reset switch 112 and a function switch 113 are connected to the CPU 104. The read switch 111 is used to display a received message on the LCD 110 while the reset switch 112 is used to replace a message being displayed with a receipt waiting message. When a stored message being read and an incoming message just received are displayed on the LCD 110 together, the function switch 113 may be operated to see only the incoming message on the LCD 110.

As shown in FIG. 2, the LCD 110, read switch 111, reset switch 112 and function switch 13 may be arranged on the front end of a casing 201 included in the pager. This allows the user of the pager to operate the switches 110–113 while watching the LCD.

Figure 3A:
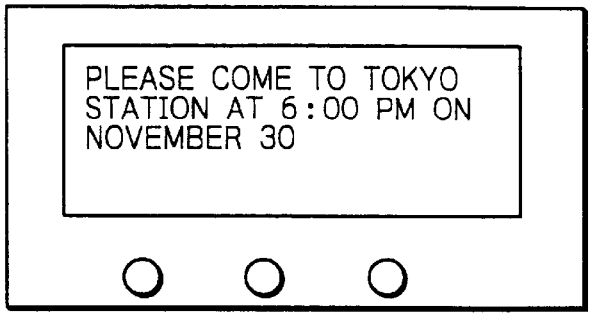
FIGS. 3A–3C show specific pictures appearing in the illustrative embodiment on the receipt of a call when a message is being displayed.

Referring also to FIGS. 3A–3C and 4, assume that the user operates the read switch 111 when a receipt waiting picture is appearing on the LCD 110. Then, the latest received message and reported to the user is read out of the RAM 105 and displayed on the LCD 110. When the user repeatedly operates the read switch 111, the second latest message and successive messages are sequentially read out of the RAM 105 and displayed on the LCD 110 (FIG. 3A).

Figure 3B:
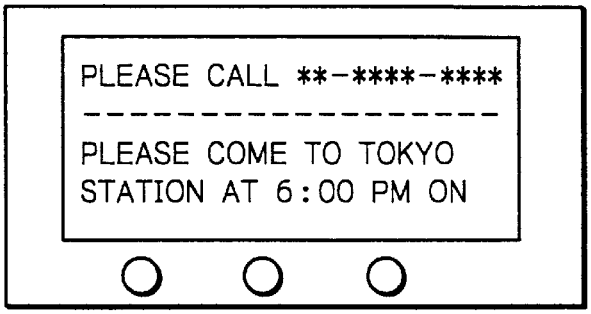
Figure 3C:
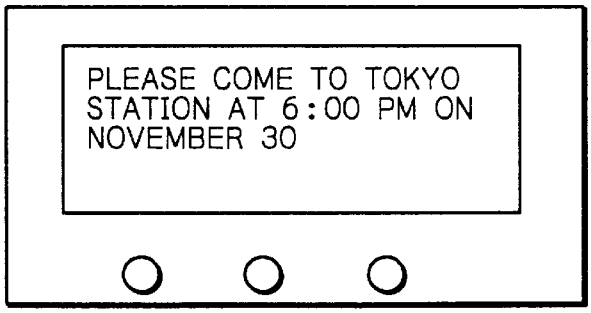

Assume that an interrupt due to a receipt, i.e., a receipt interrupt occurs in the condition shown in FIG. 3A. Then, as shown in FIG. 3B, the message reported to the user and an incoming message appear on the LCD 110 together. In the specific picture shown in FIG. 3B, "Please call --." is the incoming message. When the user watching the picture of FIG. 3B operates the read switch 111, a picture shown in FIG. 3C and identical with the picture of FIG. 3**A appears in which the incoming message is absent.

Figure 4:
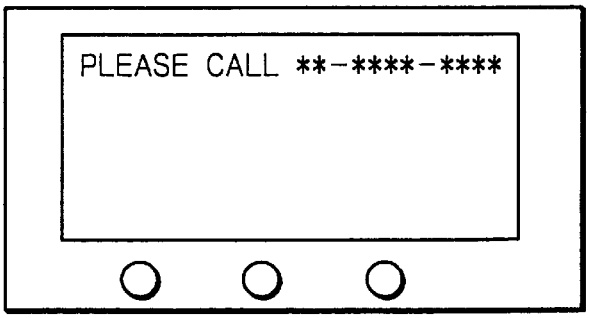
FIG. 4 shows a specific picture appearing when a function switch included in the illustrative embodiment is operated in the condition of FIG. 3B.

On the other hand, when the user watching the picture of FIG. 3B operates the function switch 113, the full incoming message appears on the LCD 110 alone, as shown in FIG. 4.

FIG. 5 shows a memory map included in the illustrative embodiment and assigned to the RAM 105. As shown, the memory map is made up of a memory number area and a message area. An incoming message is written to a frame INCOMING MESSAGE included in the message area. The latest message to the oldest message reported to the user are respectively stored in frames MESSAGE N, MESSAGE N–1, . . . , MESSAGE 1 of the message area in one-to-one correspondence to the memory numbers N, N–1, . . . , 1. After the incoming message has been reported to the user, it is shifted from the frame INCOMING MESSAGE to the frame MESSAGE N. At the same time, the messages received before the incoming message are sequentially shifted to the older message side by one frame. When the memory number of messages exceeds the capacity of the RAM 105, the oldest message is deleted.

FIG. 6 shows the memory map of FIG. 5 more specifically. As shown, the message "Please call --." of FIG. 3**B which is an incoming message is temporarily written to the frame INCOMING MESSAGE of the message area. The message "Please come to Tokyo Station at 6 p.m. on November 30." is stored in the latest message frame MESSAGE N.

Figures 7, 7A:
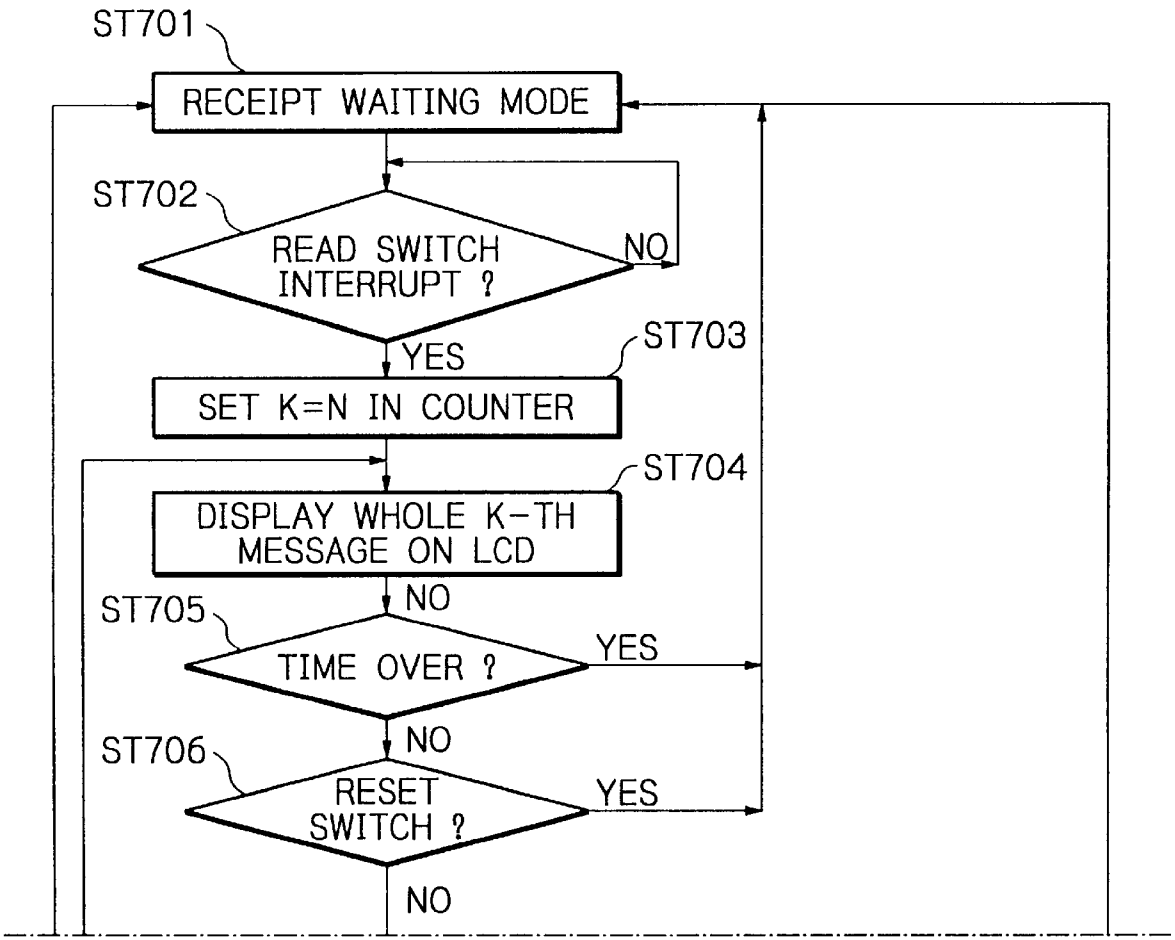
FIG. 7 is a flowchart demonstrating a specific operation of the illustrative embodiment.
Figure 7B:
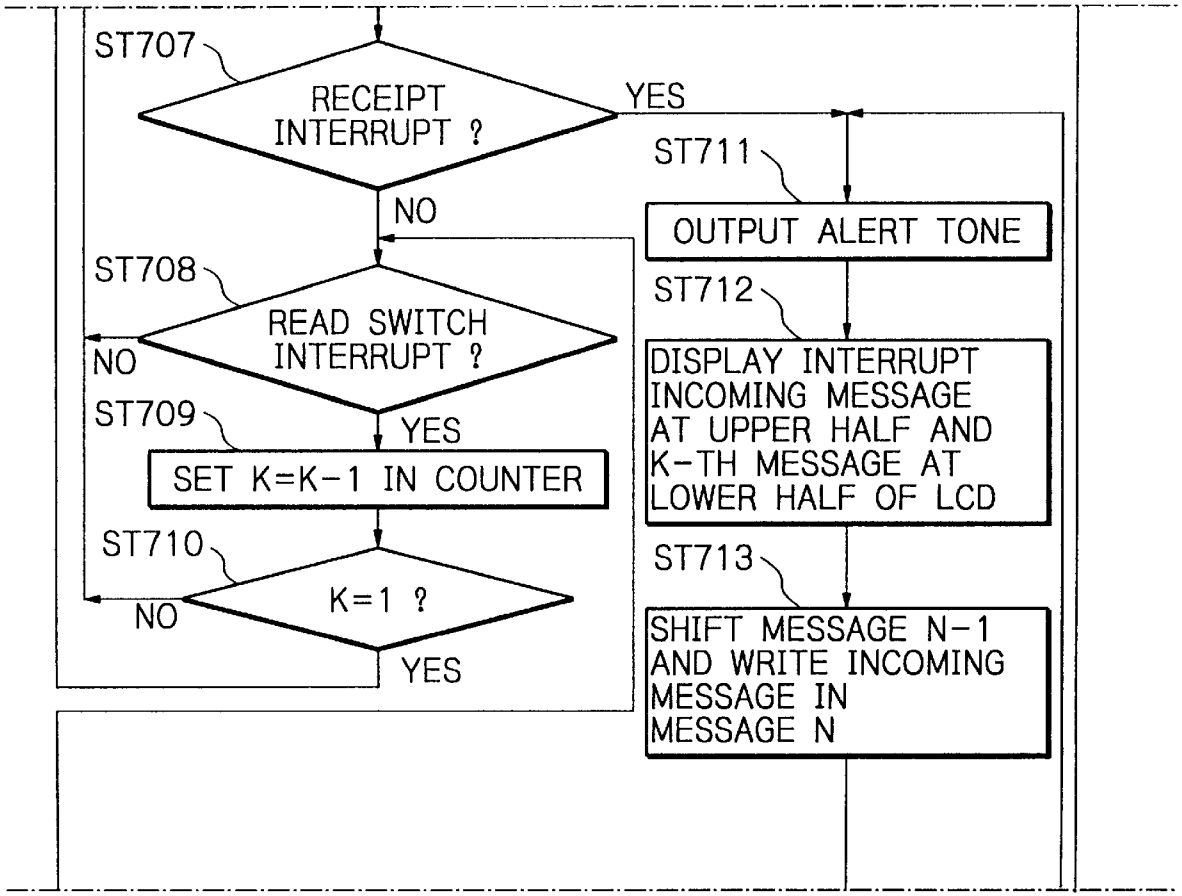
Figure 7C:
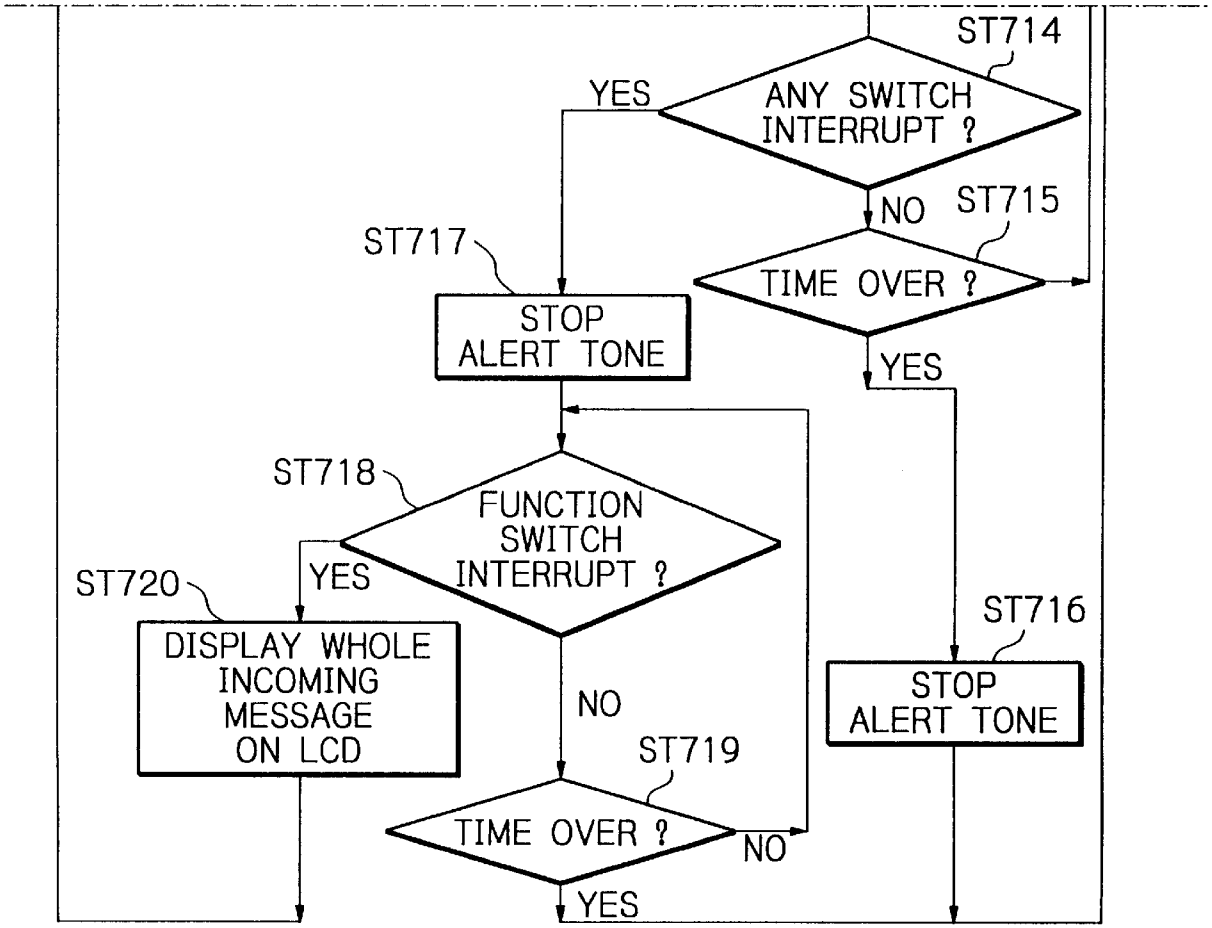

A specific operation of the illustrative embodiment will be described with reference to FIGS. 1 and 7. Assume that in a receipt waiting mode (step ST701) the user of the pager operates the read switch 111 (Yes, step ST702). Then, the CPU 104 sets K=N in a memory number counter, not shown, as a default value (step ST703) and controls the LCD controller 108 to display the whole K-th message reported to the user on the LCD 110 (step ST704). After the step ST704, when a preselected period of time expires without any switch operation (Yes, step ST705) or when an interrupt occurs due to the operation of the reset switch 112 (Yes, step ST706), the CPU 104 returns to the step ST701. On the other hand, when the above interrupt does not occur (No, step ST707), but an interrupt due to the operation of the read switch 111 occurs (Yes, step ST708), the CPU 104 sets a value K=K–1 smaller than the default value K=N in the memory number counter (step ST 709) and controls the LCD controller 108 to display the whole updated K-th message on the LCD 110 (step ST704). If the content of the memory number counter is K=1 (Yes, step ST710), meaning that the above message is the oldest message, the CPU 104 returns to the step ST701.

If the answer of the step ST707 is Yes, the CPU 104 produces an alert tone (step ST711) and then displays an incoming message at the upper half of the LCD 110 while shifting the existing message to the lower half of the LCD 110 (step ST712). Subsequently, the CPU 104 shifts the messages stored in the frames MESSAGE N through MESSAGE 1 to the older side by one frame and writes the incoming message in the latest message area MESSAGE N (step ST713).

The CPU 104 monitors the switches 111–113 for detecting an interrupt (step ST714). If any interrupt occurs (Yes, STEP ST714), the CPU 104 outputs an alert tone (step ST717). If the answer of the step ST714 is No, but a timer counts a preselected period of time (Yes, step ST715), the CPU 104 stops outputting the alert tone (step ST716) and then returns to the step ST701.

After the step ST717, the CPU 104 monitors the function switch 113 as to an interrupt (step ST718). If the timer counts a preselected period of time without the function switch 113 being operated (Yes, step ST119), the CPU 104 returns to the step ST701.

If the answer of the step ST718 is Yes, meaning that an interrupt has occurred via the function switch 113, the CPU 104 controls the LCD controller 108 to display the whole incoming message on the LCD 110 (step ST720) and then returns to the step ST708. If an interrupt occurs in the step ST708 due to the operation of the read switch 111, the CPU 104 again displays the K-th message having appeared before the interrupt.

Figure 8A:
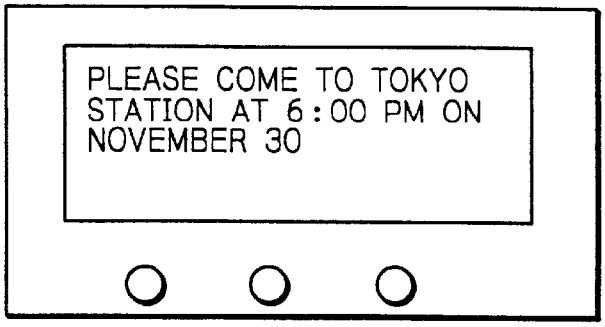
FIGS. 8A–8C show specific pictures appearing on the receipt of an information message when a message reported to the user is being displayed.

Reference will be made to FIGS. 8A–8C and 9 for describing another specific message display procedure available with the illustrative embodiment. The specific display to be described occurs when the pager receives an information message, i.e., a message transferring preselected information while displaying a received message reported to the user on the LCD 110 and when the function switch 113 thereof is operated by the user. As shown in FIG. 8A, when the user operates the read switch 111 while watching the receipt waiting picture, the CPU 104 reads the latest message reported to the user out of the RAM 105 and displays it on the LCD 110 in the same manner as described with reference to FIG. 3A. Again, when the user repeatedly operates the read switch 111, the second latest message and successive messages are sequentially read out of the RAM 105 and displayed on the LCD 110.

Figure 8B:
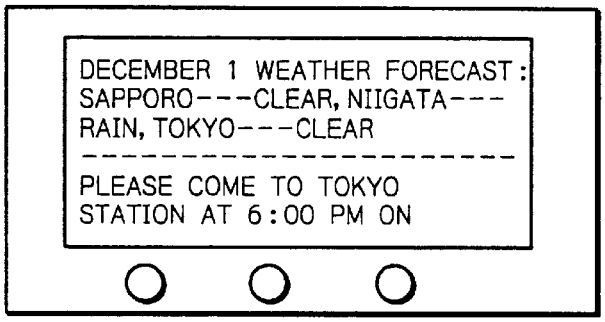

When a receipt interrupt due to an incoming information message occurs in the condition shown in FIG. 8A, part of the message read out of the RAM 105 and part of the incoming information message are displayed on the LCD 110 together, as shown in FIG. 8B. Specifically, "December 1 Weather Forecast: Sapporo . . . clear, Niigata . . . rain, Tokyo . . . clear, Nagoya . . . clear, Osaka . . . cloudy, Fukuoka . . . clear" is the incoming information message.

Figure 8C:
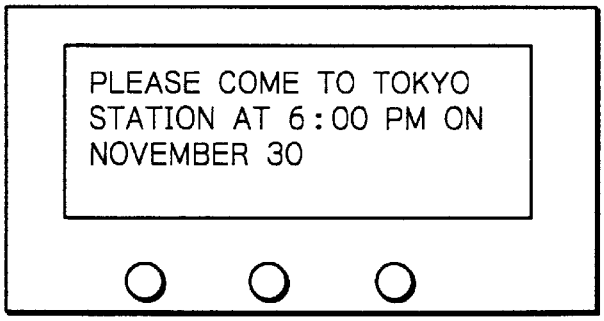

When the user operates the read switch 111 in the condition shown in FIG. 8B, the incoming message disappears on the LCD 110, as shown in FIG. 8C identical with FIG.

Figure 9:
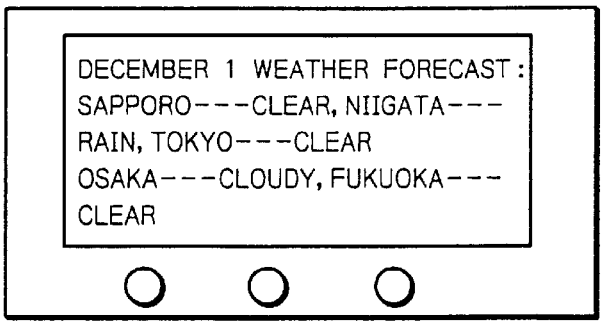
FIG. 9 shows a specific picture appearing when the function switch is operated in the condition of FIG. 8B.

8A. On the other hand, when the user operates the function key 113 in the condition shown in FIG. 8B, the whole incoming information message appears on the LCD 110 while the latest received message disappears, as shown in FIG. 9.

FIG. 10 shows another specific memory map assigned to the RAM 105, FIG. 1, and applicable to the above message display procedure. FIG. 10 is identical with FIG. 5 as far as the memory number area and message area are concerned. The memory map of FIG. 10 additionally includes an information message area INFO_MESSAGE for storing only the latest information message received.

Figures 12, 12A:
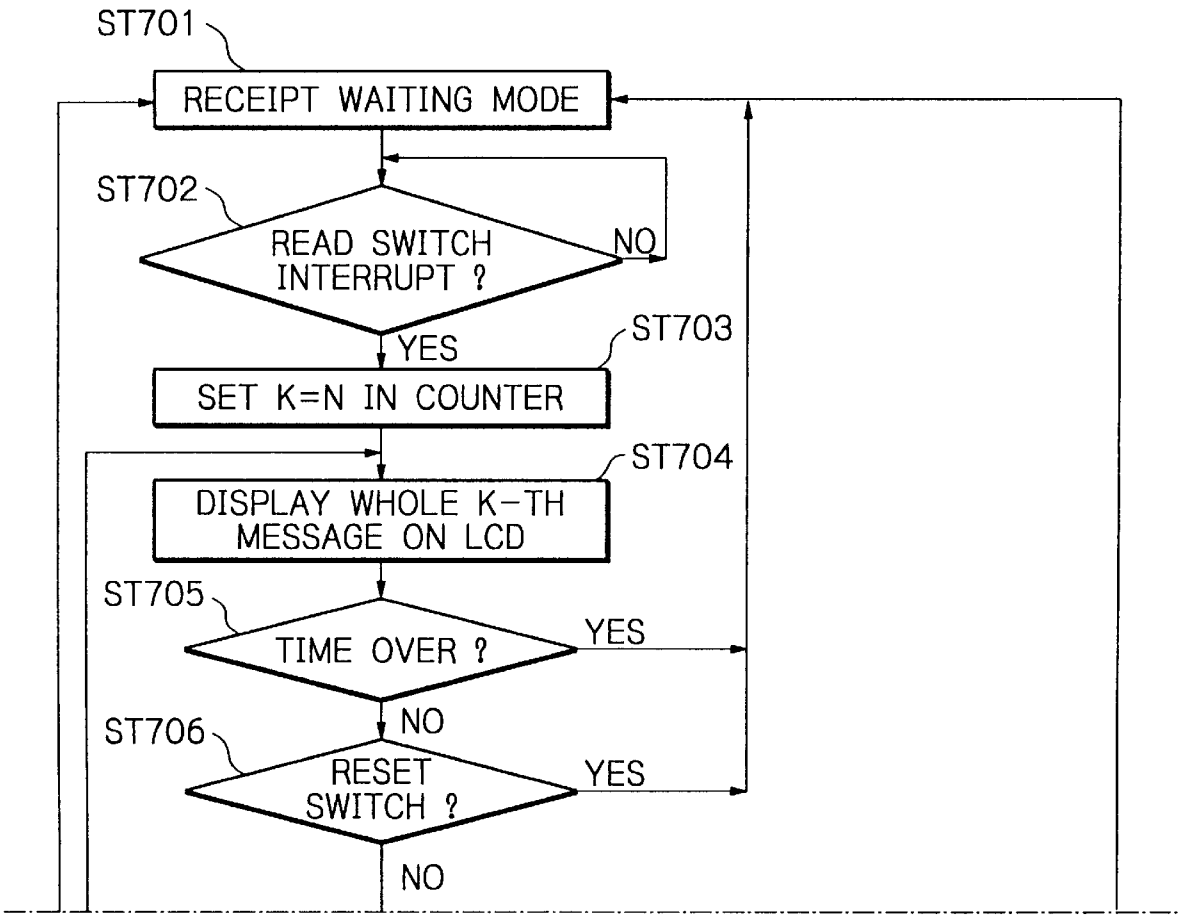
FIG. 12 is a flowchart demonstrating another specific operation of the illustrative embodiment.
Figure 12B:
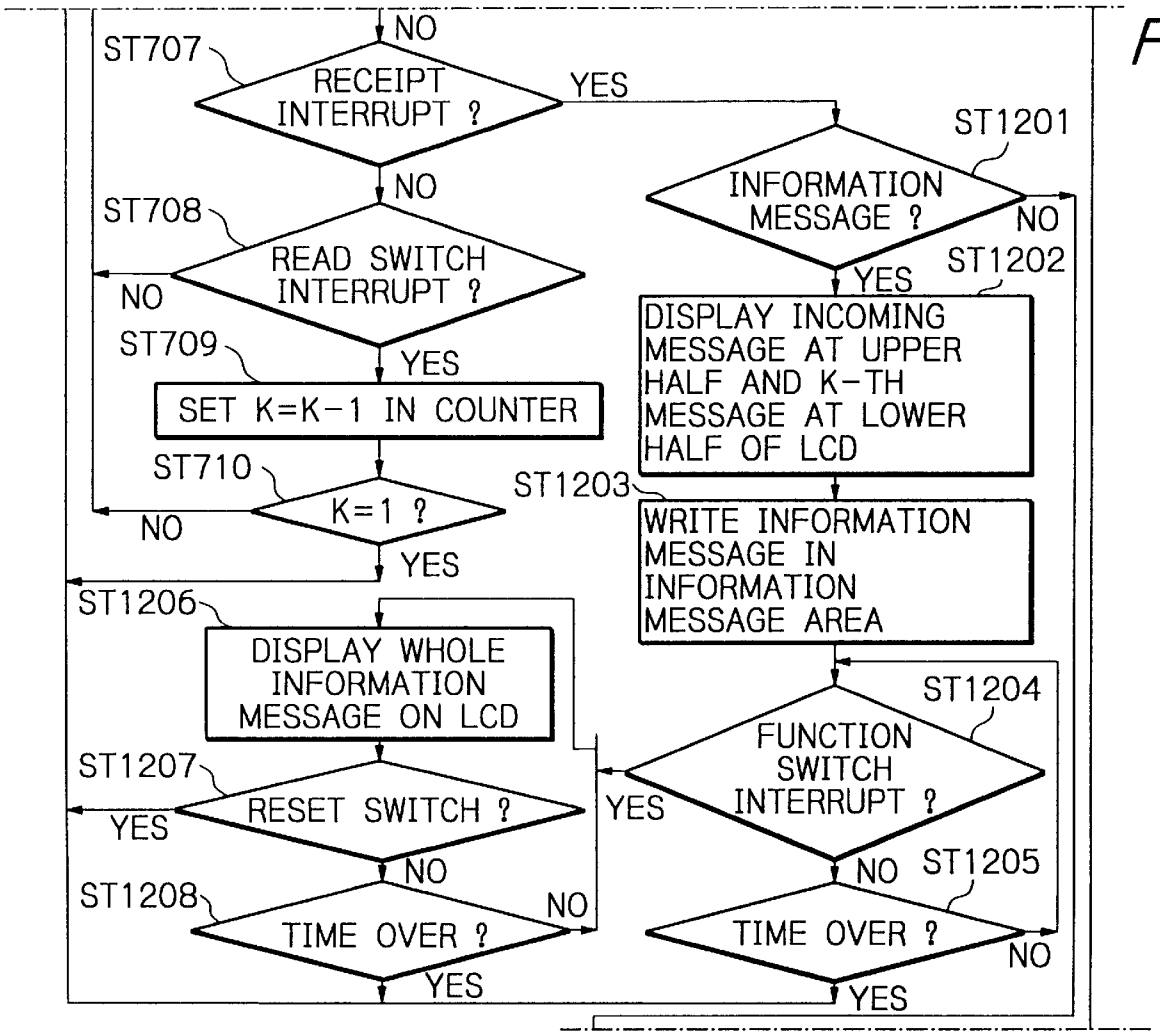
Figure 12C:
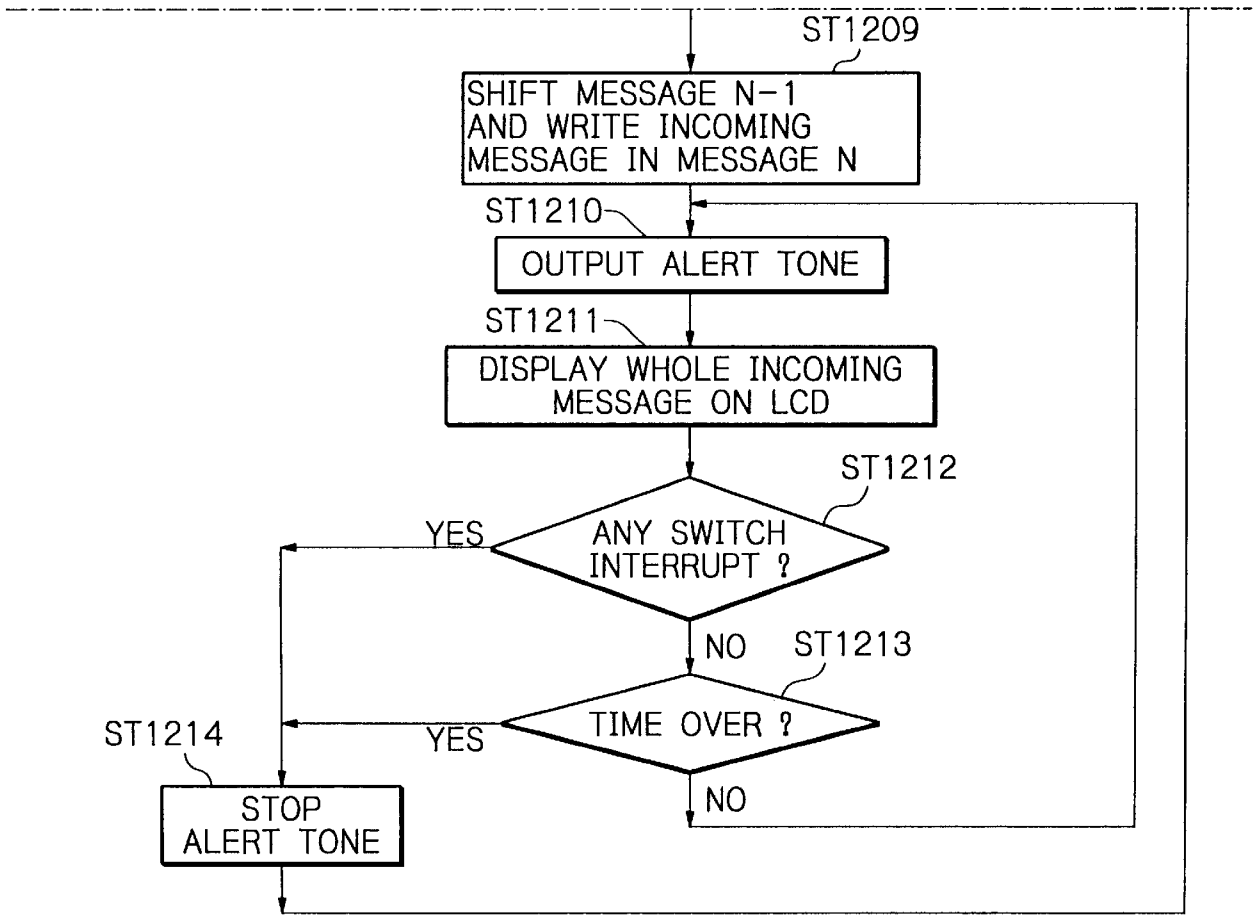

FIG. 11 shows the memory map of FIG. 10 more specifically. As shown, the information message "December 1 Weather Forecast: Sapporo . . . clear, Niigata . . . rain, Tokyo . . . clear, Nagoya . . . clear, Osaka . . . cloudy, Fukuoka . . . clear" shown in FIG. 8B is stored in the information message area INFO_MESSAGE Another specific operation of the illustrative embodiment will be described with reference to FIGS. 1 and 12. Steps ST701–ST710 shown in FIG. 12 are identical with the steps ST701–ST710 of FIG. 7 and will not be described specifically in order to avoid redundancy. As shown, assume that a receipt interrupt occurs (step ST707), and that the CPU 104 determines that an incoming message is an information message (Yes, step ST1201). Then, the CPU 104 displays the information message at the upper half of the LCD 110 while shifting the existing message to the lower half of the LCD 110 (step ST1202). Further, the CPU 104 updates the information message stored in the information message area INFO_MESSAGE of the RAM 105 (step ST1203).

After the step ST1203, the CPU 104 monitors the function switch 113 as to an interrupt (step ST1204). When an interrupt occurs (Yes, step ST1204, the CPU 104 controls the LCD controller 108 to display the whole information message on the LCD 110 while deleting the other message (step ST1206). If the timer counts the preselected period of time without the function switch 113 being operated (Yes, step ST1205), the CPU 104 returns to the step ST701. Further, the CPU 104 monitors the reset switch 112 as to an interrupt (step ST1207). If an interrupt occurs due to the operation of the reset switch 112 (Yes, step ST1207) and if the timer counts a preselected period of time (Yes, step ST1208), the CPU 104 returns to the step ST701.

If the answer of the step ST707 is Yes, but the interrupt is not derived from the receipt of an information message (No, step ST1201), the CPU 104 sequentially shifts the messages stored in the frames MESSAGE N through MESSAGE 1 of the message area to the older side by one frame while writing the incoming message in the latest message area MESSAGE N (step ST1209). Subsequently, the CPU 104 outputs an alert tone (step ST1210) and displays the whole incoming message on the LCD 110 (step ST1211). Further, the CPU 104 monitors the switches 111–113 for detecting an interrupt (step ST1212). When an interrupt occurs via any one of the switches 111–113 (Yes, step ST1212) or when the timer counts a preselected period of time without any switch interrupt (Yes, ST1213), the CPU 104 stops outputting the alert tone (step ST1214) and returns to the step S701.

In summary, in accordance with the present invention, when a receipt interrupt occurs when a received message reported to the user is being read out of a memory, an incoming message and the message being read out appear at the upper half and lower half of an LCD, respectively. This allows the user to easily see the two different messages at the same time.

Further, only when an interrupt occurs due to the receipt of an information message, both the information message and the message being read out appear on the LCD. The user can therefore immediately determine whether the incoming message is a periodic information message or another kind of message. In addition, the user can easily see the entirety of desired one of the two different messages appearing on the LCD together by operating a single switch.

Various modifications will become possible for those skilled in the art after receiving the teachings of the present disclosure without departing from the scope thereof.

What is claimed is:

1. A data display radio pager comprising:

a storage for storing a message following an address number included in a paging signal if said address number is identical with an address number assigned to said radio pager;

a display for displaying the message as a received message;

a read switch for reading the message out of said storage when operated by a user; and control means for accessing, when said read switch is operated, said storage for causing the message to be displayed on said display;

said control means causing, in the event of a receipt interrupt occurring when said control means is reading the message out of said storage, said message stored and an incoming message to be displayed on said display.

2. A radio pager as claimed in claim 1, wherein when said read switch is operated when said control means is displaying both the message stored and the incoming message, said control means causes only said message stored to be displayed on said display.

3. A radio pager as claimed in claim 1, further comprising a function switch, said control means causing, when said function switch is operated when said control means is displaying both the message stored and the incoming message, only said incoming message to be displayed on said display.

4. A data display radio pager comprising:

a storage for storing a message following an address number included in a paging signal if said address number is identical with an address number assigned to said radio pager;

a display for displaying the message as a received message;

a read switch for reading the message out of said storage when operated by a user; and control means for accessing, when said read switch is operated, said storage for causing the message to be displayed on said display;

said control means causing, in the event of a receipt interrupt occurring when said control means is reading the message out of said storage, and if an incoming message is a preselected information message, said message stored and said incoming message to be displayed on said display.

5. A radio pager as claimed in claim 4, wherein if the incoming message is not the preselected information message, said control means causes said incoming message to be displayed on said display.

6. A radio pager as claimed in claim 4, wherein when said read switch is operated when said control means is displaying both the message stored and the information message, said control means causes only said message stored to be displayed on said display.

7. A radio pager as claimed in claim 4, further comprising a function switch, said control means causing, when said function switch is operated when said control means is displaying both the message stored and the information message, only said information message to be displayed on said display.

* * * * *